US009406999B2

(12) United States Patent
Rappoport et al.

(10) Patent No.: US 9,406,999 B2
(45) Date of Patent: Aug. 2, 2016

(54) METHODS FOR MANUFACTURING CUSTOMIZED ANTENNA STRUCTURES

(75) Inventors: Benjamin M. Rappoport, Los Gatos, CA (US); Bruce E. Berg, Santa Clara, CA (US); John Raff, Menlo Park, CA (US); Stephen R. McClure, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 856 days.

(21) Appl. No.: 13/243,722

(22) Filed: Sep. 23, 2011

(65) Prior Publication Data

US 2013/0076574 A1 Mar. 28, 2013

(51) Int. Cl.
*H01Q 1/24* (2006.01)
*H01Q 9/42* (2006.01)

(52) U.S. Cl.
CPC ..... *H01Q 1/243* (2013.01); *H01Q 9/42* (2013.01); *Y10T 29/49004* (2015.01)

(58) Field of Classification Search
CPC ..... H01P 11/00; H01Q 1/42; H01Q 1/44; H01Q 1/12275; H01Q 1/243; H01Q 9/42; Y10T 29/49004
USPC ..... 29/600, 592.1, 601; 343/700 MS, 702, 343/720, 795, 872
See application file for complete search history.

(56) References Cited

U.S. PATENT DOCUMENTS

| | | | |
|---|---|---|---|
| 4,074,419 | A | 2/1978 | Hannie et al. |
| 5,045,971 | A | 9/1991 | Ono et al. |
| 5,128,829 | A | 7/1992 | Loew |
| 5,180,644 | A | 1/1993 | Bresin et al. |

(Continued)

FOREIGN PATENT DOCUMENTS

| | | |
|---|---|---|
| CN | 1361970 | 7/2002 |
| CN | 2757458 | 2/2006 |

(Continued)

OTHER PUBLICATIONS

Ho et al., "Cost Effective Integrated Housing and Printed Circuit Module for Battery Pack," ip.com Prior Art Database, Apr. 29, 2004 (6 pages).

(Continued)

*Primary Examiner* — Minh Trinh
(74) *Attorney, Agent, or Firm* — Treyz Law Group, P.C.; G. Victor Treyz; Joseph F. Guihan

(57) ABSTRACT

Antenna structures may be customized to compensate for manufacturing variations in electronic device antennas. The antenna structures may include an antenna resonating element and a ground. Customizations may be made to the antenna structures by performing customization operations such as adding material, removing material, deforming material, and making electrical adjustments. Customizations may be performed to a conductive antenna resonating element structure, to a ground structure, or to associated antenna structures such as parasitic antenna elements. During manufacturing operations, antenna structures may be characterized by making radio-frequency antenna performance measurements. Antenna performance can be compared to desired performance levels and compensating customizations for the antenna structures can be identified. Customized antenna structures can be installed in electronic devices during manufacturing to produce devices that meet desired specifications.

18 Claims, 8 Drawing Sheets

(56) References Cited

U.S. PATENT DOCUMENTS

| | | | | |
|---|---|---|---|---|
| 5,245,745 | A * | 9/1993 | Jensen et al. | 29/600 |
| 5,468,947 | A | 11/1995 | Danielson et al. | |
| 5,568,358 | A | 10/1996 | Nelson et al. | |
| 5,737,183 | A | 4/1998 | Kobayashi et al. | |
| 5,784,256 | A | 7/1998 | Nakamura et al. | |
| 5,796,575 | A | 8/1998 | Podwalny et al. | |
| 6,038,328 | A | 3/2000 | Hsu | |
| 6,137,890 | A | 10/2000 | Markow | |
| 6,144,368 | A | 11/2000 | Ooka et al. | |
| 6,153,834 | A | 11/2000 | Cole et al. | |
| 6,408,171 | B1 | 6/2002 | Schuelke et al. | |
| 6,427,017 | B1 | 7/2002 | Toki | |
| 6,452,811 | B1 | 9/2002 | Tracey et al. | |
| 6,536,589 | B2 | 3/2003 | Chang | |
| 6,746,797 | B2 | 6/2004 | Benson et al. | |
| 6,757,157 | B2 | 6/2004 | Lammintaus et al. | |
| 6,781,824 | B2 | 8/2004 | Krieger et al. | |
| 6,819,946 | B2 | 11/2004 | Hansson | |
| 6,838,810 | B1 | 1/2005 | Bovio et al. | |
| 6,847,522 | B2 | 1/2005 | Fan et al. | |
| 6,929,879 | B2 | 8/2005 | Yamazaki | |
| 7,149,557 | B2 | 12/2006 | Chadha | |
| 7,190,802 | B2 | 3/2007 | Rains et al. | |
| 7,236,357 | B2 | 6/2007 | Chen | |
| 7,297,439 | B2 | 11/2007 | Yamazaki et al. | |
| 7,336,243 | B2 | 2/2008 | Jo et al. | |
| 7,352,584 | B1 | 4/2008 | Sung | |
| 7,412,267 | B2 | 8/2008 | Eaton et al. | |
| 7,432,860 | B2 | 10/2008 | Huynh | |
| 7,515,115 | B2 | 4/2009 | Leisten et al. | |
| 7,515,431 | B1 | 4/2009 | Zadesky et al. | |
| 7,553,055 | B2 | 6/2009 | Liu | |
| 7,558,054 | B1 | 7/2009 | Prest et al. | |
| 7,558,057 | B1 | 7/2009 | Naksen et al. | |
| 7,558,396 | B2 | 7/2009 | Liu et al. | |
| 7,564,424 | B2 | 7/2009 | Umehara | |
| 7,583,987 | B2 | 9/2009 | Park | |
| 7,620,175 | B2 | 11/2009 | Black et al. | |
| 7,663,607 | B2 | 2/2010 | Hotelling et al. | |
| 7,668,332 | B2 | 2/2010 | Williams et al. | |
| 7,688,574 | B2 | 3/2010 | Zadesky et al. | |
| 7,697,281 | B2 | 4/2010 | Dabov et al. | |
| 7,733,280 | B2 * | 6/2010 | Cornwell | 343/703 |
| 7,804,451 | B2 | 9/2010 | Glocker et al. | |
| 2002/0102870 | A1 | 8/2002 | Burns et al. | |
| 2002/0107044 | A1 | 8/2002 | Kuwata et al. | |
| 2002/0114143 | A1 | 8/2002 | Morrison et al. | |
| 2003/0003945 | A1 | 1/2003 | Saiki et al. | |
| 2003/0081392 | A1 | 5/2003 | Cady et al. | |
| 2004/0084244 | A1 | 5/2004 | Zurek et al. | |
| 2004/0203518 | A1 | 10/2004 | Zheng et al. | |
| 2005/0014537 | A1 | 1/2005 | Gammon et al. | |
| 2005/0088778 | A1 | 4/2005 | Chen et al. | |
| 2005/0095745 | A1 | 5/2005 | Sapir | |
| 2006/0067070 | A1 | 3/2006 | Otsuki | |
| 2006/0119503 | A1 * | 6/2006 | Allen et al. | 342/174 |
| 2006/0157842 | A1 | 7/2006 | Goodwin | |
| 2006/0262500 | A1 | 11/2006 | Huang et al. | |
| 2007/0058821 | A1 | 3/2007 | Welsh et al. | |
| 2007/0081303 | A1 | 4/2007 | Lam et al. | |
| 2007/0160228 | A1 | 7/2007 | Yang et al. | |
| 2008/0025547 | A1 | 1/2008 | Yun et al. | |
| 2008/0037765 | A1 | 2/2008 | Finney et al. | |
| 2008/0062660 | A1 | 3/2008 | Weber et al. | |
| 2008/0069384 | A1 | 3/2008 | Kim et al. | |
| 2008/0101026 | A1 | 5/2008 | Ali | |
| 2008/0165139 | A1 | 7/2008 | Hotelling et al. | |
| 2008/0165485 | A1 | 7/2008 | Zadesky et al. | |
| 2008/0266774 | A1 | 10/2008 | Tracey et al. | |
| 2008/0316116 | A1 | 12/2008 | Hobson et al. | |
| 2008/0316121 | A1 | 12/2008 | Hobson et al. | |
| 2008/0316135 | A1 * | 12/2008 | Hilgers | 343/795 |
| 2009/0015510 | A1 | 1/2009 | Nakata et al. | |
| 2009/0049773 | A1 | 2/2009 | Zadesky et al. | |
| 2009/0059485 | A1 | 3/2009 | Lynch et al. | |
| 2009/0067141 | A1 | 3/2009 | Dabov et al. | |
| 2009/0155681 | A1 | 6/2009 | Lin et al. | |
| 2009/0160712 | A1 | 6/2009 | Breiter et al. | |
| 2009/0185045 | A1 | 7/2009 | Rosenbalt | |
| 2009/0201652 | A1 | 8/2009 | Chew et al. | |
| 2009/0245564 | A1 | 10/2009 | Mittleman et al. | |
| 2009/0257189 | A1 | 10/2009 | Wang et al. | |
| 2009/0257613 | A1 | 10/2009 | Khamashta et al. | |
| 2009/0302804 | A1 | 12/2009 | Park et al. | |
| 2010/0008040 | A1 | 1/2010 | Weber et al. | |
| 2010/0073247 | A1 | 3/2010 | Arkko et al. | |
| 2010/0271283 | A1 | 10/2010 | Sung et al. | |
| 2012/0001806 | A1 | 1/2012 | Hsiung | |
| 2012/0194998 | A1 * | 8/2012 | McClure | H01Q 1/243 361/679.56 |
| 2012/0198689 | A1 * | 8/2012 | Schlub et al. | 29/600 |
| 2013/0076573 | A1 * | 3/2013 | Rappoport | H01Q 1/243 343/702 |
| 2013/0081261 | A1 * | 4/2013 | Pienkowski | 29/600 |

FOREIGN PATENT DOCUMENTS

| | | |
|---|---|---|
| CN | 2779773 | 5/2006 |
| CN | 1870676 | 11/2006 |
| DE | 10252308 | 4/2004 |
| EP | 0534290 | 3/1993 |
| EP | 1209880 | 5/2002 |
| EP | 1257147 | 11/2002 |
| EP | 1441489 | 7/2004 |
| EP | 1732230 | 12/2006 |
| EP | 1870956 | 12/2007 |
| EP | 2343872 | 7/2011 |
| GB | 2137425 | 10/1984 |
| JP | 2003-011194 | 4/2003 |
| JP | 2004-213498 | 7/2004 |
| JP | 2005130156 | 5/2005 |
| KR | 20070047650 | 5/2007 |
| TW | 439327 B | 6/2001 |
| WO | 0148861 | 7/2001 |
| WO | 2008152438 | 12/2008 |
| WO | 2009056143 | 5/2009 |

OTHER PUBLICATIONS

Shedletsky et al., U.S. Appl. No. 12/950,793, filed Nov. 19, 2010.
Rothkopf et al., U.S. Appl. No. 12/859,712, filed Aug. 19, 2010.
Shedletsky et al., U.S. Appl. No. 61/377,866, filed Aug. 27, 2010.
Rothkopf et al., U.S. Appl. No. 12/859,694, filed Aug. 19, 2010.
Rothkopf et al., U.S. Appl. No. 12/859,702, filed Aug. 19, 2010.
Rothkopf et al., U.S. Appl. No. 12/859,711, filed Aug. 19, 2010.
Rothkopf et al., U.S. Appl. No. 12/859,701, filed Aug. 19, 2010.

* cited by examiner

METHODS FOR MANUFACTURING CUSTOMIZED ANTENNA STRUCTURES

BACKGROUND

This relates generally to electronic devices, and more particularly, to electronic devices that have antennas.

Electronic devices such as computers and handheld electronic devices are often provided with wireless communications capabilities. For example, electronic devices may use long-range wireless communications circuitry such as cellular telephone circuitry to communicate using cellular telephone bands. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz.

Antenna performance can be critical to proper device operation. Antennas that are inefficient or that are not tuned properly may result in dropped calls, low data rates, and other performance issues. There are limits, however, to how accurately conventional antenna structures can be manufactured.

Many manufacturing variations are difficult or impossible to avoid. For example, variations may arise in the size and shape of printed circuit board traces, variations may arise in the density and dielectric constant associated with printed circuit board substrates and plastic parts, and conductive structures such as metal housing parts and other metal pieces may be difficult or impossible to construct with completely repeatable dimensions. Some parts are too expensive to manufacture with precise tolerances and other parts may need to be obtained from multiple vendors, each of which may use a different manufacturing process to produce its parts.

Manufacturing variations such as these may result in undesirable variations in antenna performance. An antenna may, for example, exhibit an antenna resonance peak at a first frequency when assembled from a first set of parts, while exhibiting an antenna resonance peak at a second frequency when assembled from a second set of parts. If the resonance frequency of an antenna is significantly different than the desired resonance frequency for the antenna, a device may need to be scrapped or reworked.

It would therefore be desirable to provide a way in which to address manufacturability issues such as these so as to make antenna designs more amenable to reliable mass production.

SUMMARY

An electronic device may be provided with antenna structures. Due to manufacturing variations, the performance of the antenna structures as initially manufactured may deviate from desired performance levels.

To manufacture electronic devices with antenna structures that perform as desired, the antenna structures that are initially manufactured may be characterized using test equipment. Based on these characterizations, deviations between measured antenna performance and desired antenna performance may be identified and corresponding customizations for the antenna structures to compensate for these deviations may be identified.

The antenna structures may be processed to implement the identified customizations. For example, the antenna structures can be processed to remove material, to add material, to deform material, to apply electrical signals to adjust components such as fuses and antifuses, or to otherwise customize the antenna structures.

Once the customizations have been made to the antenna structures, the antenna structures and remaining device components can be assembled to form a completed electronic device.

Further features of the invention, its nature and various advantages will be more apparent from the accompanying drawings and the following detailed description of the preferred embodiments.

DETAILED DESCRIPTION

Figure 1:
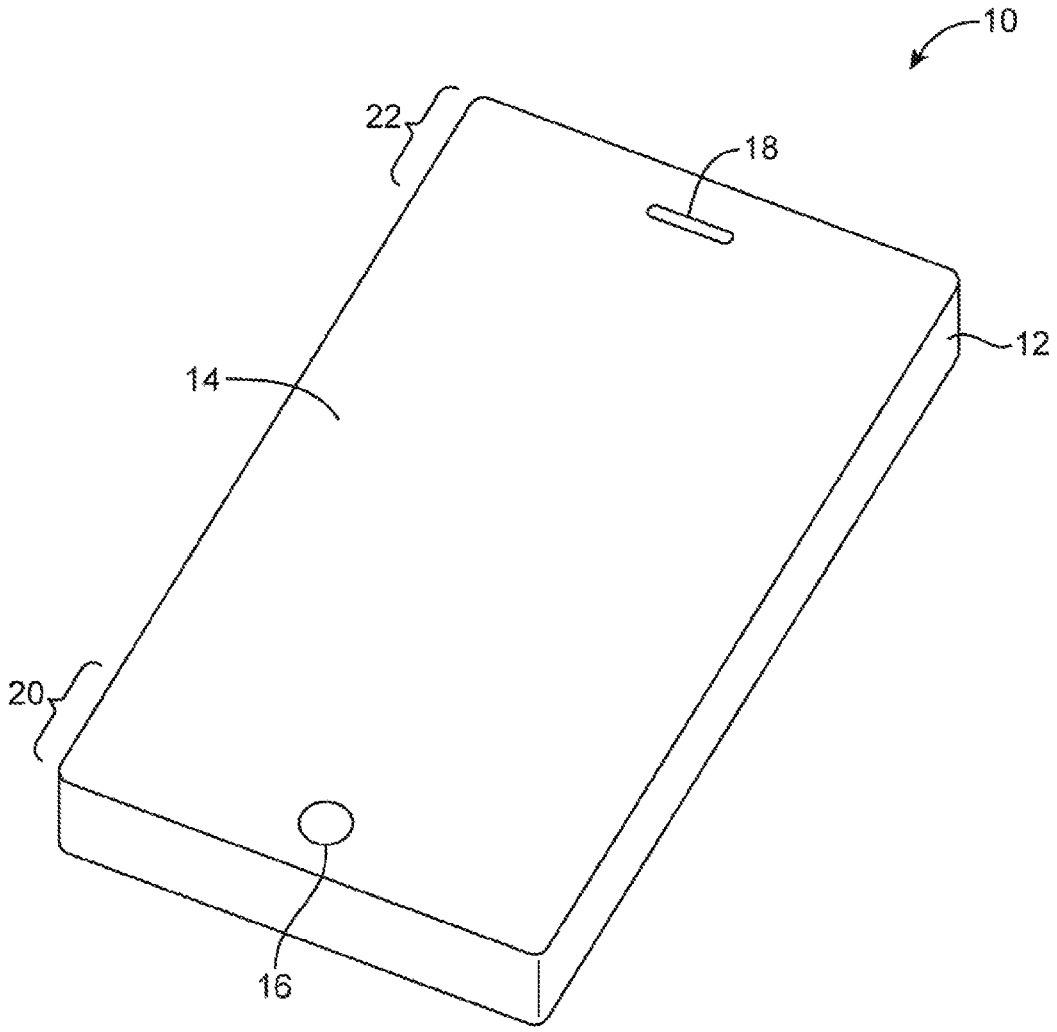
FIG. 1 is a perspective view of an illustrative electronic device with customized antenna structures in accordance with an embodiment of the present invention.

An illustrative electronic device of the type that may be provided with custom antenna structures to compensate or manufacturing variations is shown in FIG. 1. Electronic devices such as illustrative electronic device 10 of FIG. 1 may be laptop computers, tablet computers, cellular telephones, media players, other handheld and portable electronic devices, smaller devices such as wrist-watch devices, pendant devices, headphone and earpiece devices, other wearable and miniature devices, or other electronic equipment.

As shown in FIG. 1, device 10 includes housing 12. Housing 12, which is sometimes referred to as a case, may be formed of materials such as plastic, glass, ceramics, carbon-fiber composites and other fiber-based composites, metal, other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Device 10 may, if desired, have a display such as display 14. Display 14 may be a touch screen that incorporates capacitive touch electrodes or other touch sensors or may be touch insensitive. Display 14 may include image pixels formed from light-emitting diodes (LEDs), organic LEDs (OLEDs), plasma cells, electronic ink elements, liquid crystal display (LCD) pixels, or other suitable image pixel structures. A cover layer such as a cover glass member or a transparent planar plastic member may cover the surface of display 14. Buttons such as button 16 may pass through openings in the cover layer. Openings may also be formed in the glass or plastic display cover layer of display 14 to form a speaker port such as speaker port 18. Openings in housing 12 may be used to form input-output ports, microphone ports, speaker ports, button openings, etc.

Housing 12 may include a rear housing structure such as a planar glass member, plastic structures, metal structures, fiber-composite structures, or other structures. Housing 12 may also have sidewall structures. The sidewall structures may be formed from extended portions of the rear housing structure or may be formed from one or more separate members. Housing 12 may include a peripheral housing member such as a peripheral conductive housing member that runs along some or all of the rectangular periphery of device 10. The peripheral conductive housing member may form a bezel that surrounds display 14. If desired, the peripheral conductive member may be implemented using a metal band or other conductive structure that forms conductive vertical sidewalls for housing 12. Peripheral conductive housing members or other housing structures may also be used in device 10 to form curved or angled sidewall structures or housings with other suitable shapes. A peripheral conductive member may be formed from stainless steel, other metals, or other conductive materials. In some configurations, a peripheral conductive member in device 10 may have one or more dielectric-filled gaps. The gaps may be filled with plastic or other dielectric materials and may be used in dividing the peripheral conductive member into segments. The shapes of the segments of the peripheral conductive member may be chosen to form antennas with desired antenna performance characteristics (e.g., inverted-F antenna structures or loop antenna structures with desired frequency resonances).

Wireless communications circuitry in device 10 may be used to form remote and local wireless links. One or more antennas may be used during wireless communications. Single band and multiband antennas may be used. For example, a single band antenna may be used to handle local area network communications at 2.4 GHz (as an example). As another example, a multiband antenna may be used to handle cellular telephone communications in multiple cellular telephone bands. Antennas may also be used to receive global positioning system (GPS) signals at 1575 MHz in addition to cellular telephone signals and/or local area network signals. Other types of communications links may also be supported using single-band and multiband antennas.

Antennas may be located at any suitable locations in device 10. For example, one or more antennas may be located in an upper region such as region 22 and one or more antennas may be located in a lower region such as region 20. If desired, antennas may be located along device edges, in the center of a rear planar housing portion, in device corners, etc.

Antennas in device 10 may be used to support any communications bands of interest. For example, device 10 may include antenna structures for supporting local area network communications (e.g., IEEE 802.11 communications at 2.4 GHz and 5 GHz for wireless local area networks), signals at 2.4 GHz such as Bluetooth® signals, voice and data cellular telephone communications (e.g., cellular signals in bands at frequencies such as 700 MHz, 850 MHz, 900 MHz, 1800 MHz, 1900 MHz, 2100 MHz, etc.), global positioning system (GPS) communications at 1575 MHz, signals at 60 GHz (e.g., for short-range links), etc.

Figure 2:
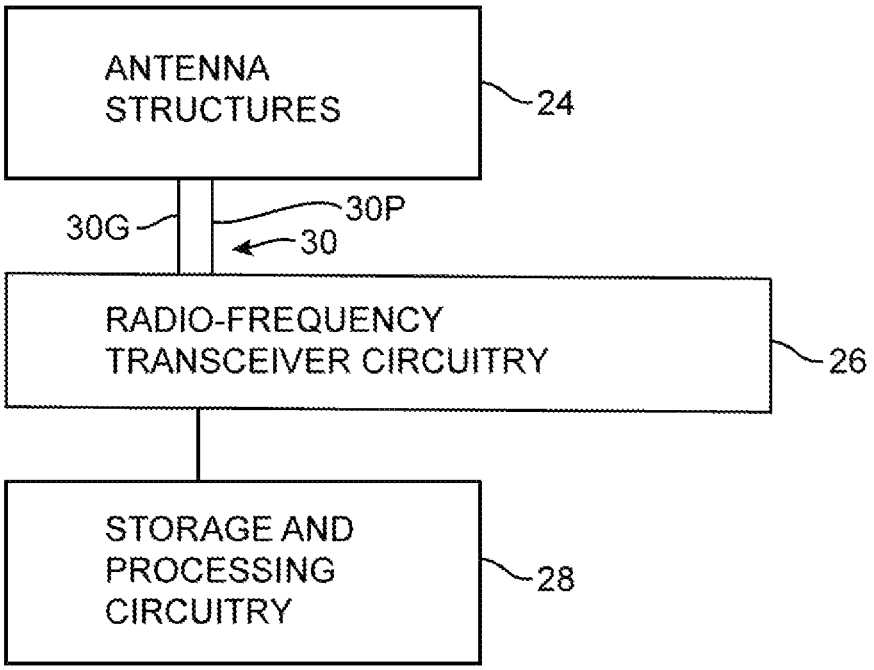
FIG. 2 is a schematic diagram of an illustrative electronic device with customized antenna structures in accordance with an embodiment of the present invention.

A schematic diagram showing illustrative components that may be used in supporting wireless communications in device 10 of FIG. 1 is shown in FIG. 2. As shown in FIG. 2, device 10 may include storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, baseband processors, etc. Input-output circuitry such as user interface components may be coupled to storage and processing circuitry 28.

Radio-frequency transceiver circuitry 26 may transmit and receive radio-frequency signals using antenna structures 24. Radio-frequency transceiver circuitry 26 may include transceiver circuitry that handles 2.4 GHz and 5 GHz bands for WiFi® (IEEE 802.11) communications, the 2.4 GHz Bluetooth® communications band, and wireless communications in cellular telephone bands at 700 MHz, 850 MHz, 900 MHz, 1800 MHz, 1900 MHz, and 2100 MHz (as examples). Circuitry 26 may also include circuitry for other short-range and long-range wireless links. For example, transceiver circuitry 26 may be used in handling signals at 60 GHz. If desired, transceiver circuitry 26 may include global positioning system (GPS) receiver equipment for receiving GPS signals at 1575 MHz or for handling other satellite positioning data.

Radio-frequency transceiver circuitry 26 may be coupled to antenna structures 24 using a transmission line such as transmission line 30. Transmission line 30 may include a positive signal conductor such as conductor (path) 30P and a ground signal conductor (path) 30G. Paths 30P and 30G may be formed on rigid and flexible printed circuit boards, may be formed on dielectric support structures such as plastic, glass, and ceramic members, may be formed as part of a cable, etc. Transmission line 30 may be formed using one or more microstrip transmission lines, stripline transmission lines, edge coupled microstrip transmission lines, edge coupled stripline transmission lines, coaxial cables, or other suitable transmission line structures.

Radio-frequency front end circuitry (e.g., switches, impedance matching circuitry, radio-frequency filters, and other circuits) may be interposed in the signal path between radio-frequency transceiver circuitry 26 and the antennas in device 10 if desired.

Antenna structures 24 may include one or more antennas of any suitable type. For example, the antennas may include antennas with resonating elements that are formed from loop antenna structure, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Due to manufacturing variations, antenna structures 24 may not always perform exactly within desired specifications when initially manufactured. For example, an antenna assembly that is formed from a peripheral conductive housing member in device 10 may be subject to performance variations that result from manufacturing variations in the peripheral conductive housing member. To ensure that each finished electronic device that is manufactured performs satisfactorily, antenna structures 24 may be characterized and customized accordingly to compensate for detected variations as part of the manufacturing process. As an example, trimming equipment may be used to trim metal parts in antenna structures 24 as part of the manufacturing process or other manufacturing equipment may be used to make antenna structure adjustments. Customization operations such as these may ensure that all completed devices that are shipped to users performed as expected, even when manufacturing variations in device components are present.

Figure 3:
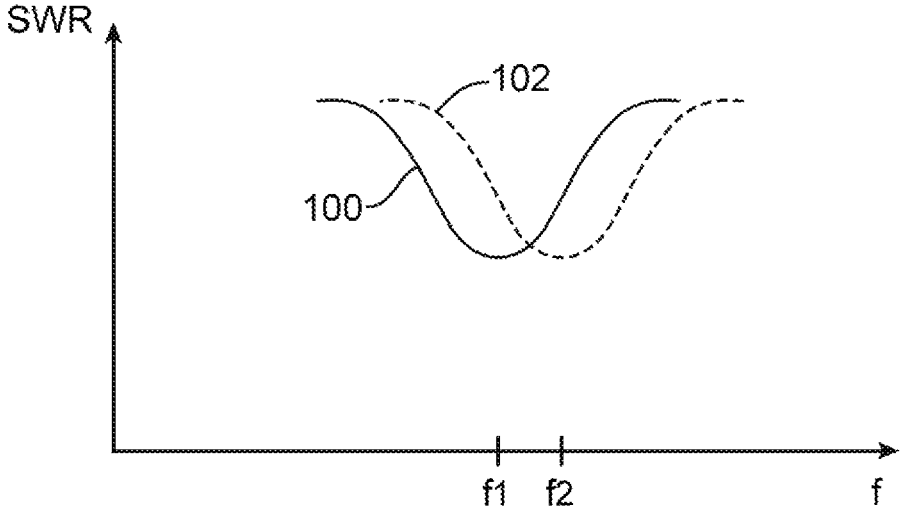
FIG. 3 is graph showing how antenna performance can be adjusted by customizing antenna structures in accordance with an embodiment of the present invention.

A graph showing how customization techniques may be used to compensate for manufacturing variations is shown in FIG. 3. In the graph of FIG. 3, antenna performance for illustrative antenna structures 24 of FIG. 2 has been characterized by plotting standing wave ratio (SWR) for antenna structures 24 as a function of operating frequency f. Due to manufacturing variations, antenna structures 24 in the FIG. 3 example are initially characterized by performance curve 100 and exhibit a frequency response peak at frequency f1, which is lower than a desired operation frequency of frequency f2. Because antenna performance is not satisfactory using antenna structures 24 as originally fabricated, appropriate customization operations may be performed on antenna structures 24. Following customization, the antenna structures may be characterized by performance curve 102 of FIG. 3 and may exhibit a frequency response peak at frequency f2, which is the desired frequency of operation.

Figure 4:
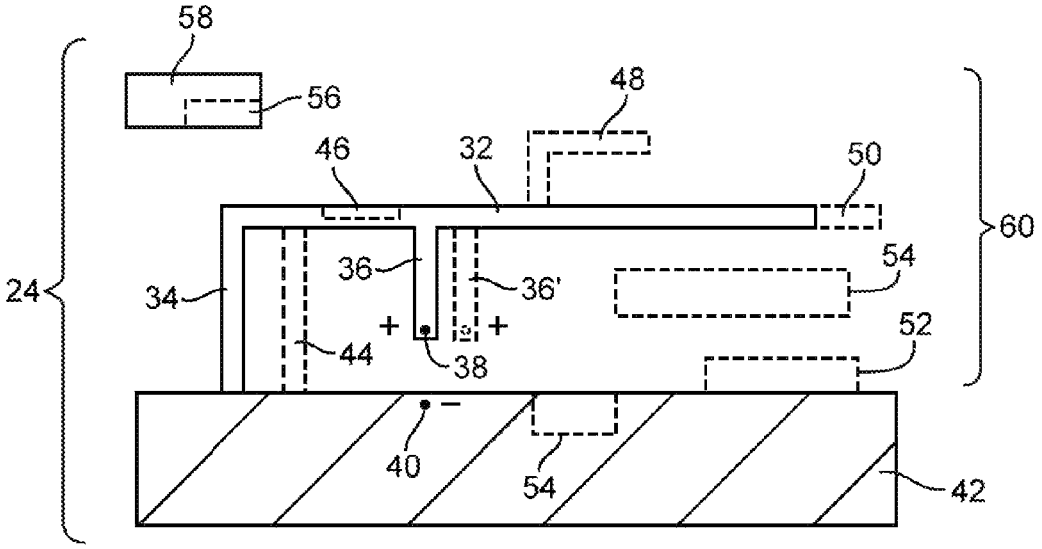
FIG. 4 is a diagram of an illustrative antenna structures showing how the antenna structures may be customized in accordance with an embodiment of the present invention.

FIG. 4 is a diagram showing illustrative ways in which antenna structures 24 may be customized. In general, any type of antenna or antennas may be used in forming antenna structures 24. In the example of FIG. 4, antenna structures 24 have been based on an inverted-F antenna design. The inverted-F antenna structures of FIG. 4 have ground plane 42 and inverted-F antenna resonating element 60. Inverted-F antenna resonating element 60 may have a main resonating element arm such as arm 32. A short circuit branch such as short circuit branch 34 may be used to couple arm 32 to ground plane 42. Antenna resonating element feed branch 36 may be coupled to positive antenna feed terminal 38. Ground antenna feed terminal 40 may be coupled to ground plane 42. Antenna feed terminals 38 and 40 may form an antenna feed for the inverted-F antenna.

The configuration of the structures such as structures that make up ground plane 42 and the structures that make up antenna resonating element 60 may affect antenna performance. Accordingly, adjustments to the conductive structures (and dielectric structures) of antenna structures 24 may be used to tune antenna structures 24 so that desired performance criteria are satisfied. If, for example, the frequency response of the inverted-F antenna is not as desired, customizing adjustments to antenna structures 24 may be made to lengthen or shorten antenna resonating element arm 32 (as an example). Adjustments may also be made to the structures that make up the antenna feed for the antenna, the structures that make up ground plane 42, parasitic antenna structures, etc.

As shown in FIG. 4, for example, adjustments may be made to antenna structures 24 to lengthen antenna resonating element arm 32 (see, e.g., illustrative added conductive material 50 at the tip of arm 32). As shown by dashed line 36', the position of antenna feed structure 36 may be adjusted. Dashed line 34' shows how the position of short circuit branch 34 may be adjusted. If desired, conductive structures may be added that change the shapes of antenna components. For example, additional conductive material such as portion 48 may be added to antenna resonating element arm 32 to adjust the performance of antenna resonating element 60 and antenna structures 24. If desired, ground plane 42 may be modified to adjust antenna structures 24. For example, material may be removed from ground plane 42 (as indicated by dashed line 54) or may be added to ground plane 42 (as indicated by dashed line 52). In some situations, the performance of an antenna in device 10 may be affected by parasitic antenna elements such as parasitic element 58. The impact of a parasitic element on antenna performance can be adjusted by adjusting the size and shape of the parasitic element. Dashed line 56 shows how parasitic antenna element material may be removed from parasitic antenna element 58 of antenna structures 24. Dashed line 54 shows parasitic antenna element material may be added to antenna structures 24 (e.g., to enlarge an existing parasitic antenna element or to add a parasitic antenna element).

The examples of FIG. 4 are merely illustrative. In general, any suitable modifications may be made to antenna structures 24 to adjust the performance of antenna structures 24 in device 10. Antenna performance may be adjusted by adding conductive structures, removing conductive structures, adding dielectric structures (e.g., adding plastic or other dielectrics to structures 24), removing dielectric structures, changing the relative positions between structures within antenna structures 24, deforming antenna structures 24, adjusting electrical components such as fuses and antifuses within structures 24, or making other antenna structure modifications.

Figure 5:
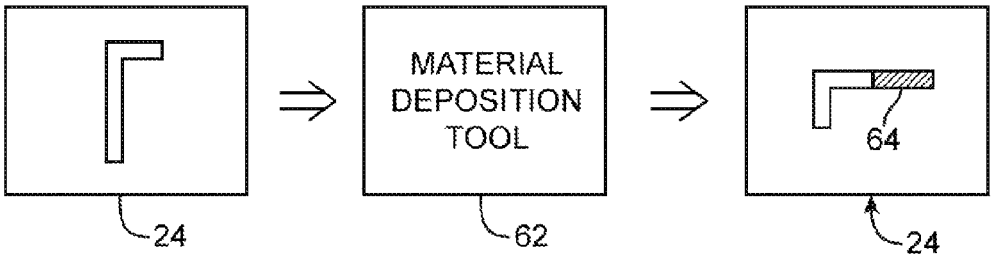
FIG. 5 is a diagram showing how a material deposition tool may be used to customize antenna structures by adding material to the structures in accordance with an embodiment of the present invention.

Any suitable equipment may be used in making antenna structure adjustments to antenna structures 24. As shown in FIG. 5, for example, antenna structures 24 can be modified using a tool that adds material to antenna structures 24 such as material deposition tool 62 or other material adding tool. Tool 62 may include equipment for adding conductive and/or dielectric material to antenna structures 24, as illustrated by additional material 64 on the right-hand side of FIG. 5. Examples of material deposition (addition) tools 62 are ink-jet printers for depositing liquid material such as conductive ink, pad printing apparatus, screen printers, brushes or other tools for applying metallic paint or other conductive liquids, conductive tape application tools, electrochemical deposition tools, physical vapor deposition tools, laser processing tools (e.g., tools for performing laser direct structuring operations by sensitizing plastic carriers for subsequent electroplating), injection molding tools (e.g., tools for forming two-shot plastic carriers that include plastic shots with different metal affinities to allow selective metal deposition during electrochemical deposition or other suitable deposition processes), soldering tools for adding solder, welding tools for adding additional metal structures, etc.

Figure 6:
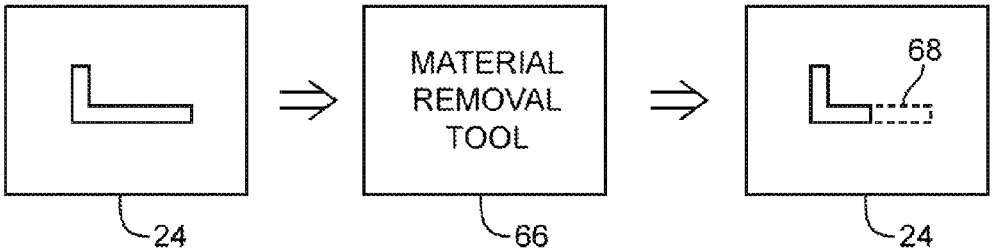
FIG. 6 is a diagram showing how a material removal tool may be used to customize antenna structures by removing material from the structures in accordance with an embodiment of the present invention.

FIG. 6 shows how antenna structures 24 may be customized using material removal tool 66. Material removal tool 66 may be used to selectively remove metal structures or other structures within antenna structures 24, as indicated by removed portion 68 of antenna structures 24 on the right-hand side of FIG. 6. Examples of tools 66 that are suitable for removing material from antenna structures 24 include plasma cutting and etching tools, wet and dry etching tools, ion milling tools, laser trimming tools, milling machines, drills, saws, and other physical machining tools, etc.

Figure 7:
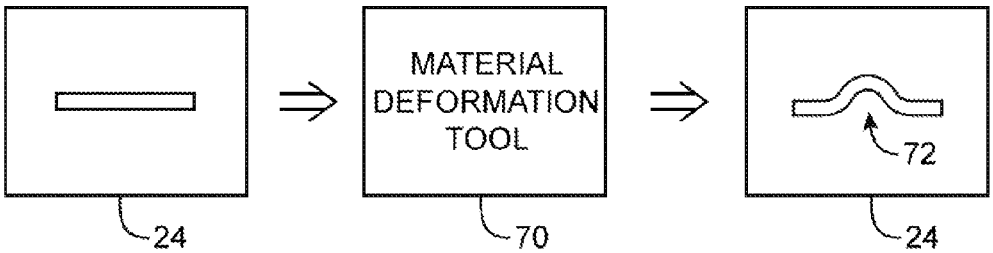
FIG. 7 is a diagram showing how a material deformation tool may be used to customize antenna structures by deforming material in the structures in accordance with an embodiment of the present invention.

As shown in FIG. 7, antenna structures 24 may be customized using material deformation tool 70. Material deformation tool 70 may, for example, apply localized heat from a laser or other heat source to cause substrate materials to swell, bend, or otherwise deform. As shown in the right-hand side of FIG. 7, for example, use of material deformation tool 70 may create deformations such as deformation 72 in antenna structures 24. Deformation 72 may be caused by heating, application of light, application of electrons or other particles, or application of other sources of energy.

Figure 8:
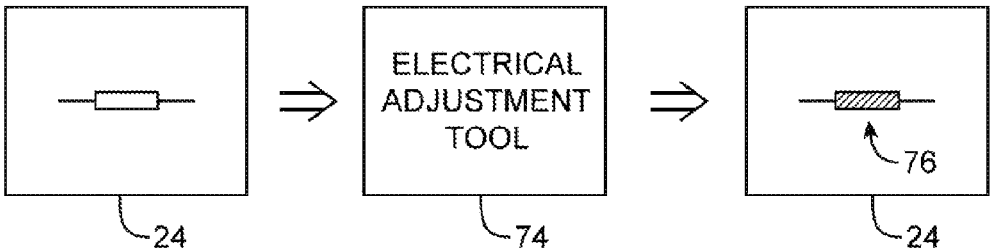
FIG. 8 is a diagram showing how an electrical adjustment tool such as a computer-based controller may be used to customize antenna structures by applying electrical signals to the antenna structures in accordance with an embodiment of the present invention.

As shown in FIG. 8, a computer-controlled signal generator or other electrical adjustment tool 74 may be used to make electrical adjustments to antenna structures 24 by applying electrical signals to portions of antenna structures 24. Electrical adjustment tool 74 may be for example, a computer-controlled voltage source or current source. Examples of components that may be configured using tool 74 include fuses and antifuses. Fuses are initially closed circuits that become open circuits when a sufficiently large electrical signal is applied (i.e., a current over the rating of the fuse to blow the fuse). Antifuses operate similarly, but initially form open circuits that are closed by application of sufficiently large electrical signals.

Figure 9:
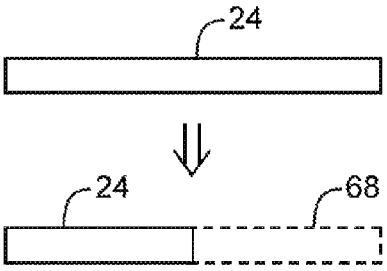
FIG. 9 is a diagram showing how a material removal tool may be used to customize antenna structures by removing a portion of an antenna structure to form a structure with a reduced size in accordance with an embodiment of the present invention.
Figure 10:
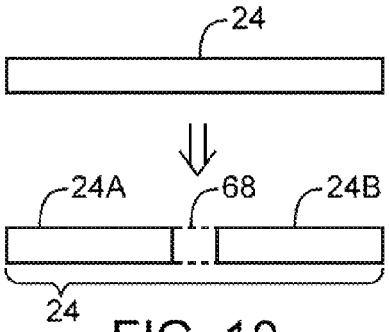
FIG. 10 is a diagram showing how a material removal tool may be used to customize antenna structures by removing a portion of an antenna structure to create an open circuit between separate portions of the antenna structure in accordance with an embodiment of the present invention.

FIG. 9 shows how antenna structures 24 may be customized by removing material 68. Material removal operations may be used to shorten the length of an antenna structure, to narrow the width of an antenna structure, to create an enlarged dielectric gap between adjacent conductive members, to change the geometry of a conductive structure in antenna structures 24, or to otherwise make modifications to antenna structures 24. FIG. 10 shows how antenna structures may be customized by removing material to produce a dielectric gap such as gap 68. In the FIG. 10 example, antenna structures 24 initially include a solid conductive structure such as a strip of metal. As shown in the lower portion of FIG. 10, following customization by removal of some of the strip of metal, a gap such as gap 68 has been formed that separates the strip into separate conductive pieces such as metal structure 24A and metal structure 24B.

Figure 11:
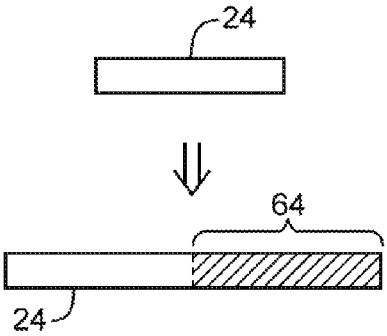
FIG. 11 is a diagram showing how a material deposition tool may be used to customize antenna structures by adding material to the antenna structures to create larger structures in accordance with an embodiment of the present invention.

FIG. 11 shows how antenna structures 24 may be customized by adding material 64 to extend the length of a conductor. Additional material may be added to antenna structures 24 to increase the length of a structure, to increase the width of a structure, to cause adjacent conductive structures to become closer to one another, to change the shape of a conductive antenna structure, etc.

Figure 12:
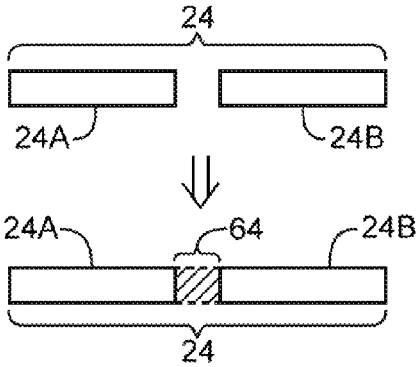
FIG. 12 is a diagram showing how a material deposition tool may be used to customize antenna structures by adding material to antenna structures to create a short circuit that electrically joins separate portions of the antenna structures together to form a unified antenna structure in accordance with an embodiment of the present invention.

FIG. 12 shows how antenna structures 24 can be customized to join separate antenna structures. In the FIG. 12 example, antenna structures 24 initially contain two separate antenna structures 24A and 24B. Following addition of material 64, structures 24A and 24B are electrically joined to form a single conductive structure. Additional material 64 may be solder, material added by welding, conductive ink (paint), an additional customized structure that contains customized metal structures on a dielectric substrate, etc.

Figure 13:
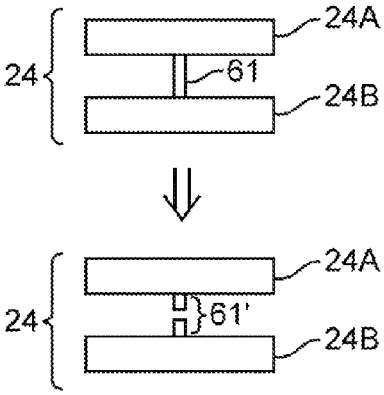
FIG. 13 is a diagram showing how an electrical adjustment tool may be used to customize antenna structures by electrically adjusting a component such as a fuse to create an open circuit between portions of the antenna structure in accordance with an embodiment of the present invention.

FIG. 13 shows how antenna structures 24 may be customized by blowing a fuse such as fuse 61. In the example of FIG. 13, fuse 61 initially has an unblown state and electrically shorts antenna structures 24A and 24B together. Following application of current using a tool such as electrical adjustment tool 74 of FIG. 8, fuse 61 may be blow to form an open circuit (see, e.g., blown fuse 61' in the lower portion of FIG. 13). When the fuse is blown, the fuse forms an open circuit and no longer connects structures 24A and 24B to each other.

Figure 14:
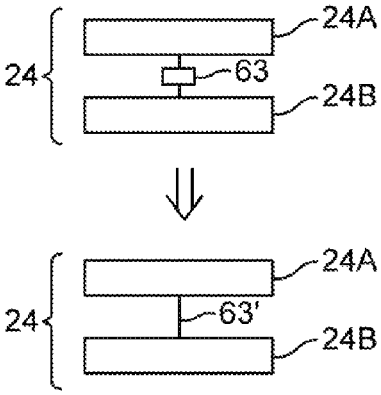
FIG. 14 is a diagram showing how an electrical adjustment tool may be used to customize antenna structures by electrically adjusting a component such as an antifuse to create a short circuit that electrically joins separate portions of the antenna structures together to form a unified antenna structure in accordance with an embodiment of the present invention.

In the example of FIG. 14, antenna structures 24 are being customized using antifuse 63. Initially, antifuse 63 is in an open circuit state (the upper portion of FIG. 14), in which structures 24A and 24B are not electrically shorted to each other through antifuse 63. Following application of an electrical signal using electrical adjustment tool 74 of FIG. 8, antifuse 63' may be placed in its low-resistance state to electrically short conductive structure 24A to conductive structure 24B.

Figure 15:
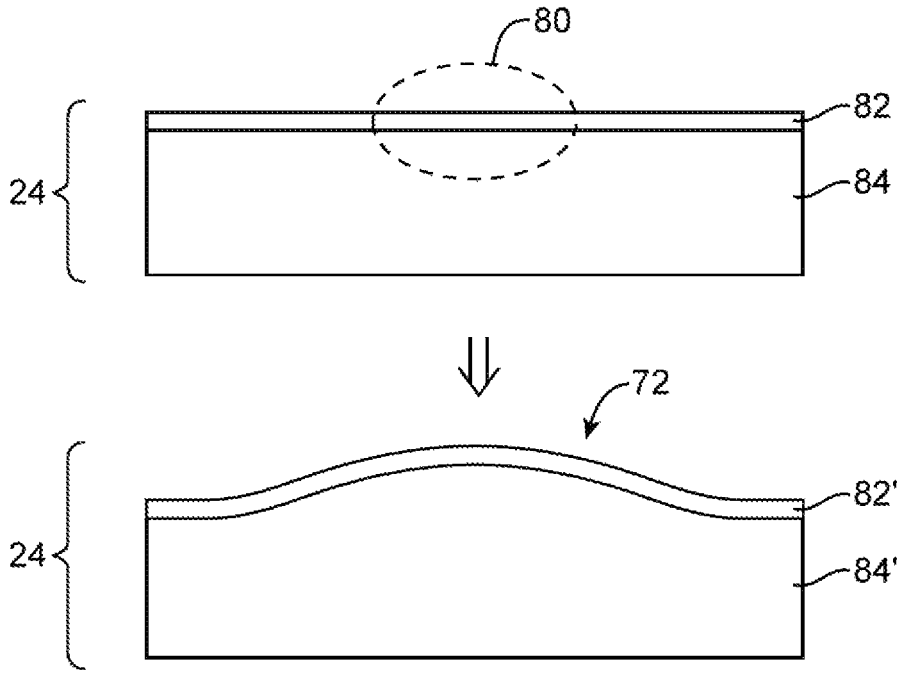
FIG. 15 is a diagram showing how a material deformation tool may be used to customize antenna structures by deforming material in the structures in accordance with an embodiment of the present invention.

An illustrative antenna structure customization process that involves deforming antenna structures 24 is shown in FIG. 15. Initially, structures 24 contain two planar members 82 and 84, as shown in the cross-sectional side view of antenna structures 24 in the upper portion of FIG. 15. Upper member 82 may be a metal layer. Lower member 84 may be a dielectric substrate such as a polymer substrate. Following application of heat or other forms of energy in region 80 (e.g., using material deformation tool 70 of FIG. 7), the exposed portion of material in antenna structures 24 deforms (e.g., by swelling or bending upwards), forming deformed portion 72 in antenna structures 24, as shown in the lower portion of FIG. 15. The deformation of the antenna structures can affect antenna performance by changing the length of conductive structures, by altering the shape of conductive structures, by altering the distance between conductive structures, etc.

Figure 16:
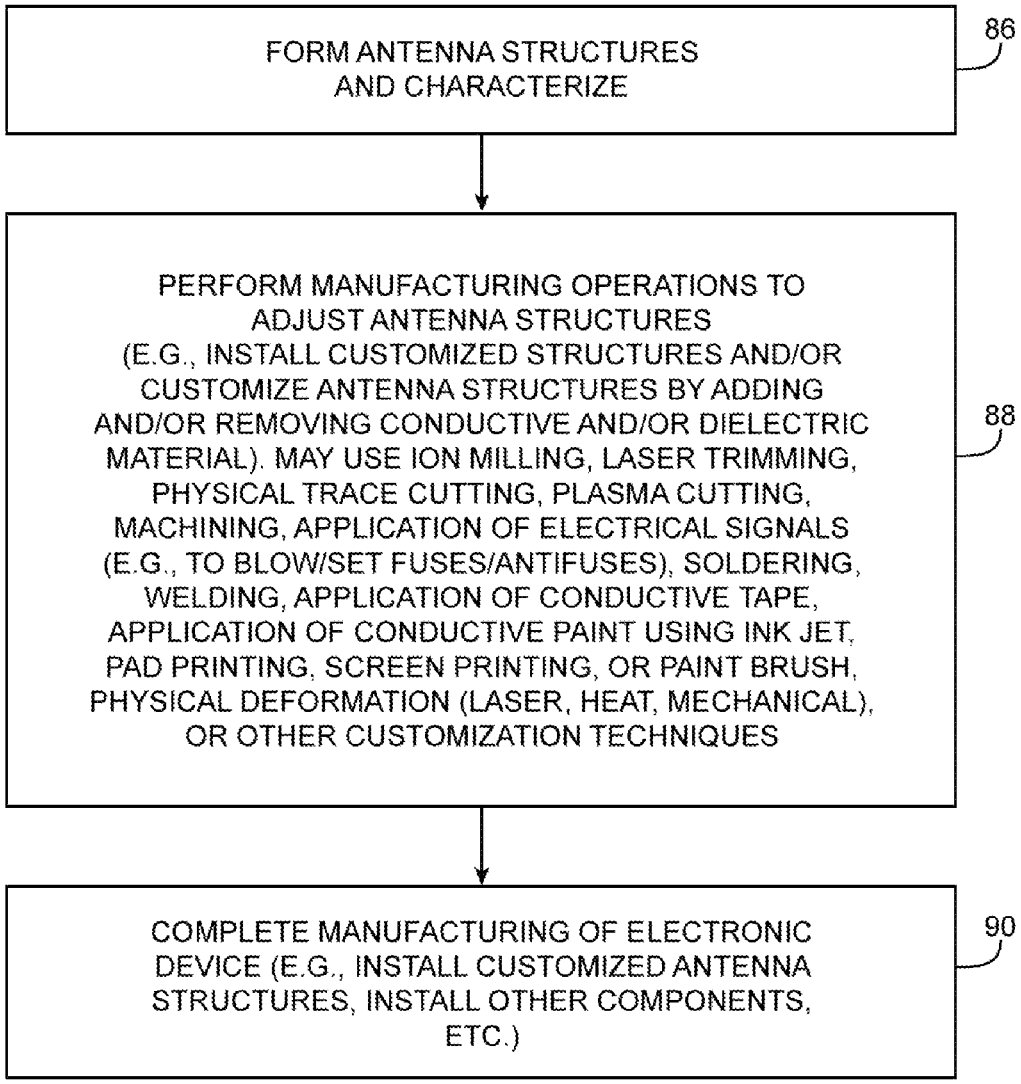
FIG. 16 is a flow chart of illustrative steps involved in characterizing antenna performance and compensating for manufacturing variations by customizing antenna structures in accordance with an embodiment of the present invention.

A flow chart of illustrative steps involved in manufacturing devices such as electronic device 10 of FIG. 1 that include custom antenna structures 24 is shown in FIG. 16.

At step 86, antenna structures 24 and other device structures can be formed according to nominal (not customized) specifications. During the manufacturing process of step 86, parts for a particular design of device 10 and antenna structures 24 may be manufactured and collected for assembly. Parts may be manufactured by numerous organizations, each of which may use different manufacturing processes. As a result, there may be manufacturing variations in the parts that can lead to undesirable variations in the antenna performance for antenna structures 24 if not corrected. These performance variations may be characterized using test equipment such as network analyzers (e.g., vector network analyzers) and other radio-frequency test equipment and associated computer equipment. The test equipment may make measurements antenna frequency response and other performance measurements and may use these antenna performance measurements to determine how to customize the antenna structures to compensate for performance variations.

The test equipment may identify variations in antenna performance from desired performance levels by comparing measured performance data to curves of expected performance (e.g. high and low limit data) or may use other performance criteria. Based on identified deviations between actual and desired performance, the test equipment may ascertain which corrective actions should be taken when customizing antenna structures 24. The test equipment may produce reports or other output data for use in manually making manufacturing adjustments to antenna structures 24 and/or may produce control signals that automatically adjust manufacturing equipment to customize antenna structures 24 (i.e., control signals or other output that directs the manufacturing equipment to make identified customizations).

At step 88, manufacturing operations may be performed to customize antenna structures 24 in accordance with the corrective actions (customizations) identified during the operations of step 86. Manufacturing operations may be performed to add conductive material and/or dielectric material to antenna structures 24 using material adding tools such as tool 62 of FIG. 5. For example, the size and shape of conductive antenna resonating element structures, parasitic antenna elements, and ground plane structures may be changed by adding conductive material. Manufacturing operations may be performed to remove conductive and/or dielectric material using material removal tools such as material removal tool 66 of FIG. 6. For example, an antenna resonating element, antenna ground, or parasitic antenna element may be adjusted in size and/or shape by removing conductive material. Tools such as material deformation tool 70 of FIG. 6 may be used in customizing antenna structures 24 by deforming conductive and/or dielectric structures in antenna structures 24. Tools such as tool 74 of FIG. 8 may be used to make customizing electrical adjustments to electrical components such as fuses and antifuses.

By customizing antenna structures 24 using techniques such as these or other suitable manufacturing techniques, antenna structures 24 may be customized to compensate for the performance variations identified during the operations of step 86. Following antenna structure customization, remaining manufacturing steps associated with manufacturing complete devices 10 may be performed (step 90). During these steps, the customized version of antenna structures 24 may be installed within device housing 12, antenna structures 24 may be coupled to transceiver circuitry 36 using transmission line 30, and remaining components may be installed within device 10 to form a completed unit.

The foregoing is merely illustrative of the principles of this invention and various modifications can be made by those skilled in the art without departing from the scope and spirit of the invention. The foregoing embodiments may be implemented individually or in any combination.

What is claimed is:

1. A method of producing customized antenna structures for an electronic device using manufacturing equipment, comprising:

forming antenna structures for an electronic device using the manufacturing equipment;

identifying manufacturing variations in the antenna structures by measuring radio-frequency antenna performance of the antenna structures using the manufacturing equipment, wherein identifying the manufacturing variations comprises determining whether the antenna structures comprise two separate conductive structures separated by a gap;

identifying customizations to be made to the antenna structures to compensate for the identified manufacturing variations using the manufacturing equipment; and making the identified antenna structure customizations to the antenna structures to produce customized antenna structures for the electronic device using the manufacturing equipment, wherein making the identified antenna structure customizations comprises adding conductive material that joins the two separate conductive structures in the antenna structures to produce the customized antenna structures.

2. The method defined in claim 1 wherein making the identified antenna structure customizations comprises adding dielectric material to the electronic device antenna structures.

3. The method defined in claim 1 wherein adding the conductive material comprises depositing conductive material with a material deposition tool.

4. The method defined in claim 3 wherein adding the conductive material comprises adding conductive material using a technique selected from the group consisting of: soldering, welding, applying conductive paint, and applying conductive tape.

5. The method defined in claim 1 wherein making the identified antenna structure customizations comprises removing dielectric material from the electronic device antenna structures.

6. The method defined in claim 1 wherein making the identified antenna structure customizations comprises removing conductive material from antenna structures.

7. The method defined in claim 6 wherein removing the conductive material comprises removing the conductive material with a material removal tool selected from the group consisting of: a laser trimming tool, an ion milling tool, a physical machining tool, and a plasma cutting tool.

8. The method defined in claim 6 wherein removing the conductive material comprises removing conductive material from a conductive antenna structure in the antenna structures to form two conductive structures separated by a gap.

9. The method defined in claim 1 further comprising:

with the manufacturing equipment, assembling the electronic device to include the customized antenna structures.

10. A method of producing customized antenna structures using manufacturing equipment, comprising:

forming antenna structures using the manufacturing equipment;

identifying manufacturing variations in the antenna structures by measuring radio-frequency antenna performance of the antenna structures using the manufacturing equipment;

identifying customizations to be made to the antenna structures to compensate for the identified manufacturing variations using the manufacturing equipment; and making the identified antenna structure customizations on the antenna structures to produce customized antenna structures using the manufacturing equipment, wherein making the identified antenna structure customizations comprises bending material in the antenna structures to produce the customized antenna structures.

11. The method defined in claim 10 wherein deforming the material comprises bending at least one metal structure in the antenna structures.

12. The method defined in claim 10 wherein bending the material comprises applying heat to the antenna structures.

13. A method of producing customized antenna structures using manufacturing equipment, comprising:

forming antenna structures using the manufacturing equipment, wherein the antenna structures comprise a fuse;

identifying manufacturing variations in the antenna structures by measuring radio-frequency antenna performance of the antenna structures using the manufacturing equipment;

identifying customizations to be made to the antenna structures to compensate for the identified manufacturing variations using the manufacturing equipment; and making the identified antenna structure customizations on the antenna structures to produce customized antenna structures using the manufacturing equipment, wherein making the identified antenna structure customizations comprises applying electrical signals to the fuse in the antenna structures.

14. A method of manufacturing customized antenna structures for an electronic device using manufacturing equipment, the method comprising:

forming antenna structures using the manufacturing equipment;

measuring radio-frequency performance of the antenna structures to identify manufacturing variations using the manufacturing equipment;

identifying customizations to make to the antenna structures to compensate for manufacturing variations using the manufacturing equipment;

making the identified customizations to produce customized antenna structures by removing conductive material from a conductive antenna structure in the antenna structures to form two conductive structures separated by a gap using the manufacturing equipment; and manufacturing the electronic device to include the customized antenna structures.

15. The method defined in claim 14 wherein making the identified customizations comprises removing a portion of electronic device antenna structures to produce the customized antenna structures.

16. The method defined in claim 15 wherein removing the portion of the electronic device antenna structures comprises removing a portion of a conductive antenna resonating element to produce the customized antenna structures from a remaining portion of the conductive antenna resonating element.

17. The method defined in claim 15 wherein removing the portion of the electronic device antenna structures comprises removing a portion of an antenna ground conductor to produce the customized antenna structures.

18. The method defined in claim 14 wherein the customized antenna structures include a parasitic antenna element and wherein making the identified customizations comprises adjusting the parasitic antenna element.

* * * * *